US011037742B2

(12) United States Patent
Horiuchi et al.

(10) Patent No.: US 11,037,742 B2
(45) Date of Patent: Jun. 15, 2021

(54) KEYBOARD DEVICE

(71) Applicant: Chicony Electronics Co., Ltd., New Taipei (TW)

(72) Inventors: Mitsuo Horiuchi, New Taipei (TW); Chia-Hsin Chen, New Taipei (TW); Po-Hsin Li, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/874,249

(22) Filed: May 14, 2020

(65) Prior Publication Data

US 2020/0402745 A1 Dec. 24, 2020

Related U.S. Application Data

(60) Provisional application No. 62/863,428, filed on Jun. 19, 2019.

(30) Foreign Application Priority Data

Aug. 29, 2019 (TW) ..... 108131142

(51) Int. Cl.
*H01H 13/79* (2006.01)
*H01H 13/703* (2006.01)

(52) U.S. Cl.
CPC ..... *H01H 13/79* (2013.01); *H01H 13/703* (2013.01); *H01H 2203/056* (2013.01)

(58) Field of Classification Search
CPC . H01H 13/79; H01H 13/703; H01H 2203/056
See application file for complete search history.

(56) References Cited

U.S. PATENT DOCUMENTS 3,676,607 A * 7/1972 Nash ..... H01H 13/702 379/361
8,299,382 B2 * 10/2012 Takemae ..... H01H 3/125 200/344
8,481,874 B2 * 7/2013 Takagi ..... H01H 3/125 200/5 A
9,842,710 B2 * 12/2017 Maruyama ..... H01H 3/125
2005/0013645 A1 * 1/2005 Tsai ..... G06F 1/1616 400/472

(Continued)

*Primary Examiner* — Kyung S Lee
(74) *Attorney, Agent, or Firm* — Muncy, Geissler, Olds & Lowe, P.C.

(57) ABSTRACT

A keyboard device includes a substrate, keycaps, and a frame. The substrate has a top surface and a bottom surface and includes a welding-fixing portion. The welding-fixing portion includes a through hole and an arch-shaped bridge member. The arch-shaped bridge member is connected in the through hole and divides the through hole into partition holes. The arch-shaped bridge member has an arch portion and bridge bases. The arch portion protrudes from the top surface to form a recessed portion. The frame is disposed on the top surface and includes hollow holes respectively corresponding to the keycaps. The frame includes a welding member, and the welding member includes welding posts and a welding-fixing base. The welding posts respectively pass through spaces between the edge portion of the through hole and the arch-shaped bridge member. The welding-fixing base is received and fixed in the through hole and the recessed portion.

12 Claims, 6 Drawing Sheets

(56) References Cited

U.S. PATENT DOCUMENTS

| | | | | |
|---|---|---|---|---|
| 2010/0009211 | A1* | 1/2010 | Tsai | B23K 31/02 428/596 |
| 2011/0108401 | A1* | 5/2011 | Yamada | H01H 3/125 200/302.1 |
| 2014/0131181 | A1* | 5/2014 | Chen | H01H 13/88 200/237 |
| 2015/0348725 | A1* | 12/2015 | Tamura | B32B 3/266 156/91 |

* cited by examiner

KEYBOARD DEVICE

CROSS-REFERENCES TO RELATED APPLICATIONS

This application claims the priority benefit of U.S. provisional application Ser. No. 62/863,428, filed on Jun. 19, 2019 and Patent Application No. 108131142 filed in Taiwan, R.O.C. on Aug. 29, 2019. The entirety of the above-mentioned patent applications are hereby incorporated by references herein and made a part of the specification.

BACKGROUND

Technical Field

The instant disclosure relates to an input device, in particular, to a keyboard device.

Related Art

Keyboards are common input devices. Usually, they are used along with daily computer products (such as laptops, notebook computers, smart phones, or tablets), industrial scaled control equipment, or processing equipment for operation or text inputs.

SUMMARY

In general, a keyboard known to the inventor(s) has a substrate, a frame, and several keycaps, the frame and the keycaps are disposed on the substrate, and the fixation between the frame and the substrate may be achieved by hot-welding. A common approach for the hot-welding process is that, the substrate has welding holes corresponding to welding posts on the frame, and the welding posts on the frame are welded and fixed with the welding holes. However, in most cases, the welding posts of the frame pass through the welding holes and welded and fixed on the bottom surface of the substrate, causing the bottom surface of the substrate being uneven, thereby being detrimental for assembling other components on the bottom surface of the substrate. Moreover, before being assembled on the bottom surface of the substrate, the components to be assembled on the bottom surface of the substrate has to undergo the hole-blowing process to eschew the welding portions on the bottom surface, and the hole-blowing process thereby damaging the structural strength of the components and affecting the performance of the components.

In view of this, in one embodiment, a keyboard device is provided. The keyboard comprises a substrate, a plurality of keycaps, and a frame. The substrate has a top surface and a bottom surface opposite to the top surface. The top surface comprises a welding-fixing portion. The welding-fixing portion comprises a through hole and an arch-shaped bridge member. The through hole is defined through the top surface and the bottom surface. The arch-shaped bridge member is connected in the through hole and divides the through hole into a plurality of partition holes. The arch-shaped bridge member has an arch portion and a plurality of bridge bases extending from the arch portion. The bridge bases are connected to an edge portion of the through hole. The arch portion protrudes from the top surface to form a recessed portion. The keycaps are disposed on the top surface of the substrate. The frame is disposed on the top surface of the substrate. The frame comprises a plurality of hollow holes respectively corresponding to the keycaps. The frame comprises a welding member, and the welding member comprises a plurality of welding posts and a welding-fixing base connected to end portions of the welding posts. The frame is leaned on the arch portion, the welding posts respectively pass through spaces between the edge portion of the through hole and the arch-shaped bridge member, and the welding posts respectively correspond to the partition holes. The end portion of the welding posts are hot-welded and solidified to form the welding-fixing base, and the welding-fixing base is received and fixed in the through hole and the recessed portion.

Based on the above, in the keyboard device according to one or some embodiments of the instant disclosure, the arch-shaped bridge member is connected in the through hole of the welding-fixing portion of the substrate, and the arch-shaped bridge member has the arch portion protruding from the top surface of the substrate and forms the recessed portion. Hence, portions of the welding-fixing base of the welding member of the frame can be welded and fixed in the recessed portion and do not protrude out of the bottom surface of the substrate. Therefore, the bottom surface of the substrate is even, facilitating the assembly of other components (e.g., the backlight module) on the bottom surface of the substrate. Moreover, the components to be assembled on the bottom surface are not necessarily provided with blow holes and still can eschew the welding-fixing post. Consequently, the structural strengths of the components to be assembled on the bottom surface can be retained, and the performances of the components to be assembled on the bottom surface can be properly exploited. Moreover, the welding member of the frame can enclose the arch-shaped bridge member, so that the welding member can have a proper pulling capacity, thereby enhancing the fixation strength of the frame on the substrate.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
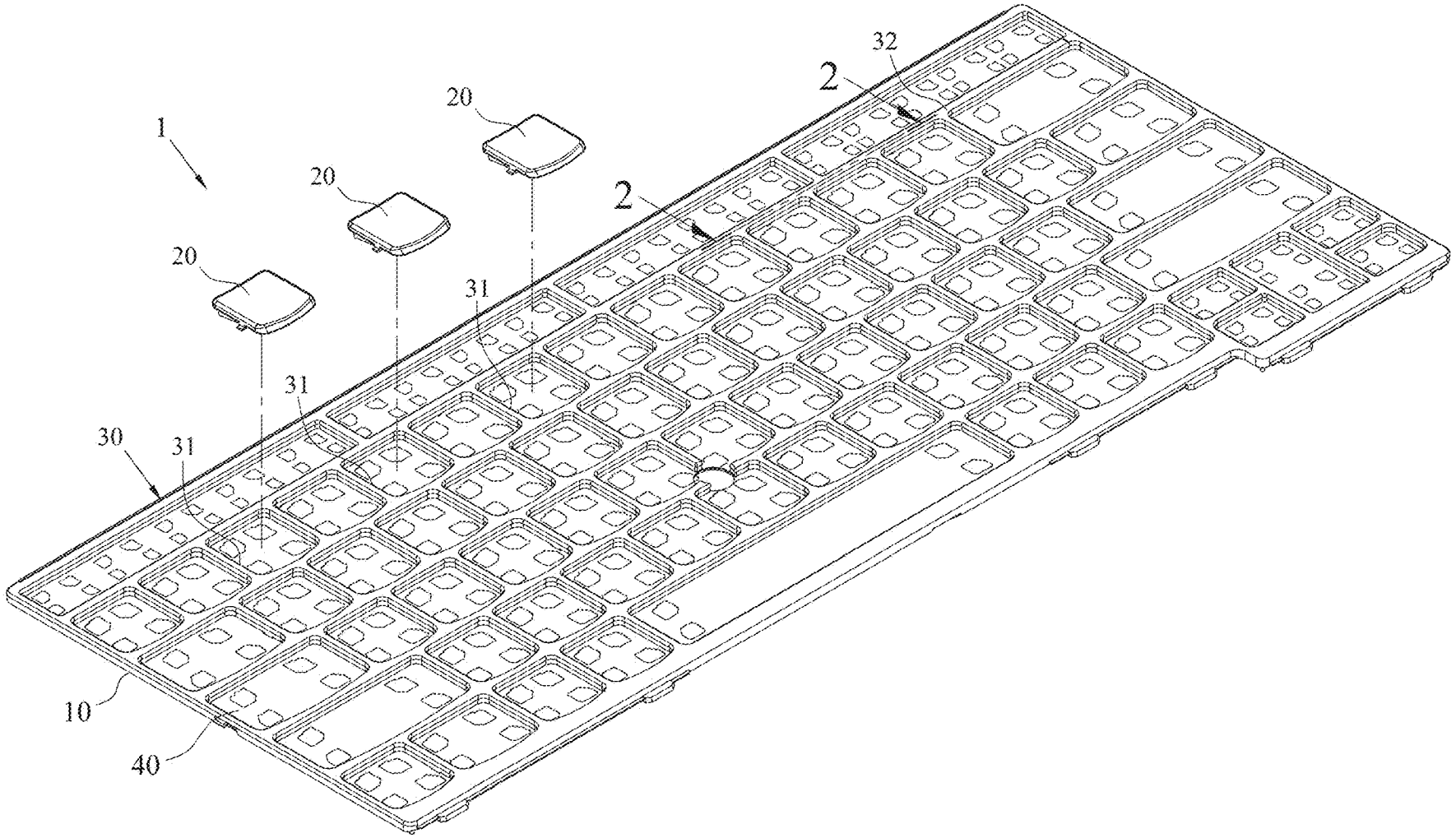
FIG. 1 illustrates a perspective view of a keyboard device according to a first embodiment of the instant disclosure.

FIG. 1 illustrates a perspective view of a keyboard device according to a first embodiment of the instant disclosure.

Figure 2:
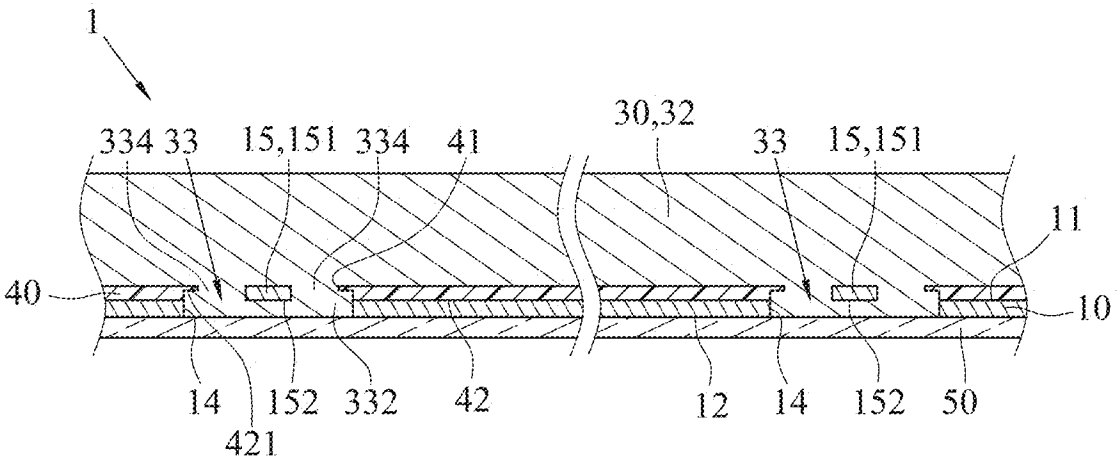
FIG. 2 illustrates a cross-sectional view along line 2-2 shown in FIG. 1.
Figure 3:
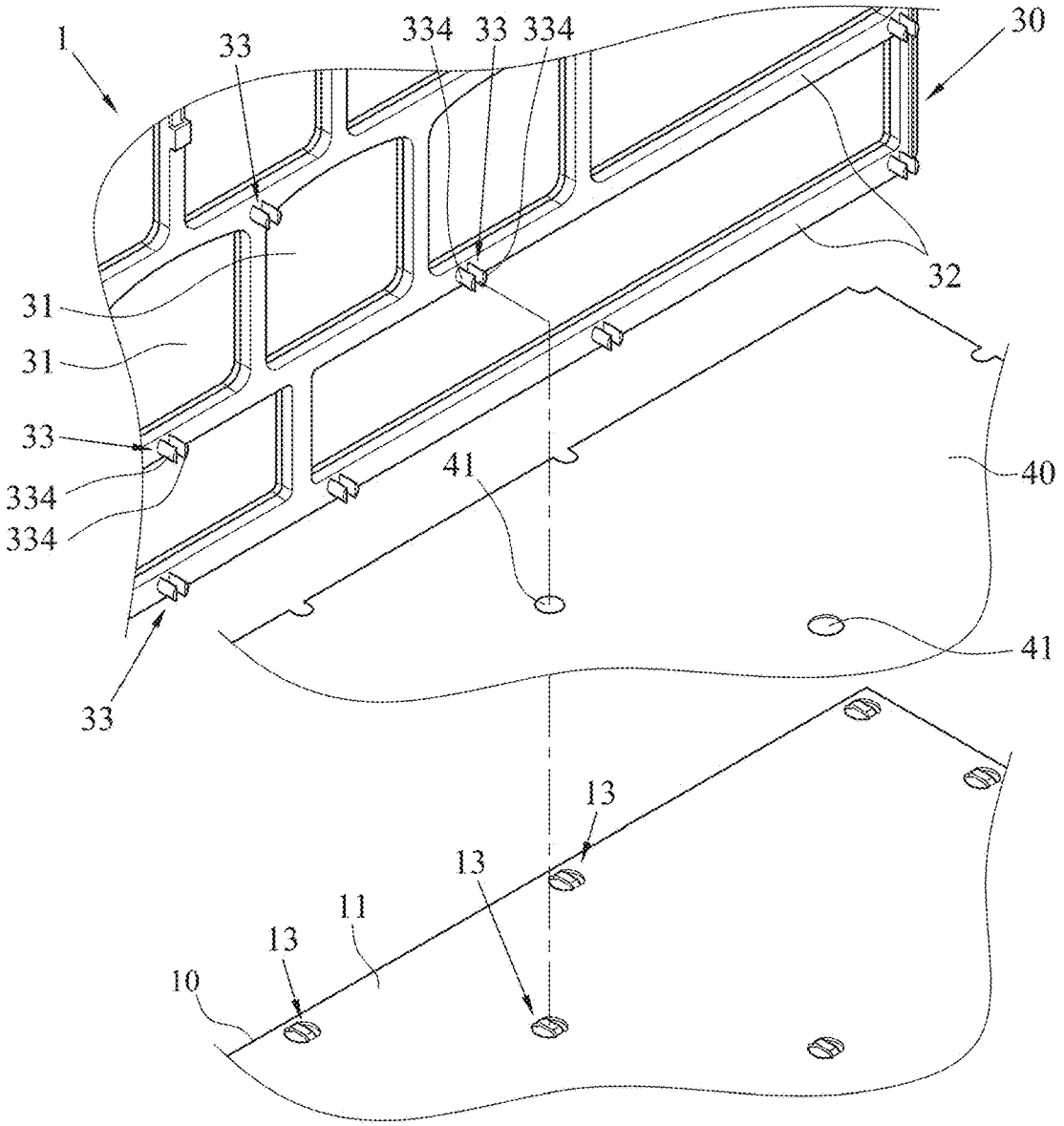
FIG. 3 illustrates a partial exploded view of the keyboard device of the first embodiment.
Figure 4:
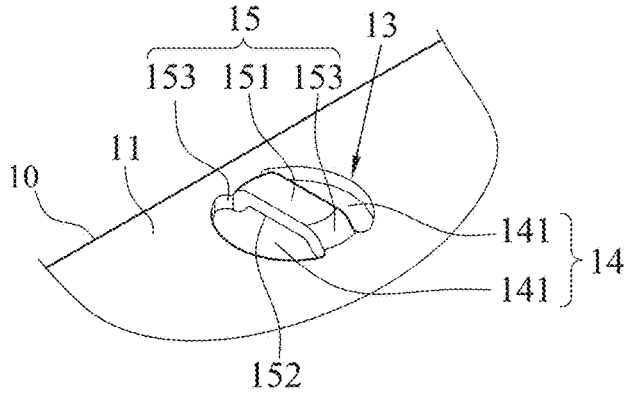
FIG. 4 illustrates an enlarged partial perspective view of FIG. 3.

FIG. 2 illustrates a cross-sectional view along line 2-2 shown in FIG. 1. FIG. 3 illustrates a partial exploded view of the keyboard device of the first embodiment. FIG. 4 illustrates an enlarged partial perspective view of FIG. 3. As shown in FIGS. 1 to 4, in this embodiment, the keyboard device 1 comprises a substrate 10, a plurality of keycaps 20, and a frame 30. The frame 30 and the keycaps 20 are disposed on the substrate 10.

As shown in FIGS. 1 to 4, the substrate 10 may be a rigid plate made of metal (e.g., iron, aluminum, alloy, etc.), or plastic material for performing a supporting function. The substrate 10 has a top surface 11 and a bottom surface 12 opposite to the top surface 11, and the substrate 10 comprises at least one welding-fixing portion 13 (as shown in FIG. 3, in this embodiment, the substrate 10 comprises a plurality of welding-fixing portions 13) for welding and fixing with the frame 30. As shown in FIGS. 3 and 4, in this embodiment, each of the welding-fixing portions 13 comprises a through hole 14 and an arch-shaped bridge member 15. The through hole 14 is defined through the top surface 11 and the bottom surface 12 of the substrate 10. The arch-shaped bridge member 15 is connected in the through hole 14 and divides the through hole 14 into a plurality of partition holes 141. The arch-shaped bridge member 15 has an arch portion 151 and a plurality of bridge bases 153 extending from the arch portion 151. The bridge bases 153 are connected to an edge portion of the through hole 14. The arch portion 151 protrudes from the top surface 11 of the substrate 10, so that a recessed portion 152 is formed below the arch portion 151. In this embodiment, the through hole 14 is of a circular shape, but embodiments are not limited thereto; the through hole 14 may be of other shapes (e.g., rectangular, elliptical, trapezoidal, or the like). A number of the bridge bases 153 for each of the arch-shaped bridge members 15 is two, and for each of the arch-shaped bridge members 15, the two bridge bases 153 are respectively extending from two opposite ends of the arch portion 151, so that the arch-shaped bridge member 15 is of a linear shape to divide the through hole 14 into two partition holes 141, where the two partition holes 141 are of a semicircular shape, but embodiments are not limited thereto; indeed, it is understood that the shape of the partition hole 141 depends on the shape of the through hole 14.

In some embodiments, the arch-shaped bridge member 15 may be a portion of the substrate 10 and is formed by stamping or bending. In other words, supposed that the substrate 10 is a metal plate, the arch-shaped bridge member 15 is a bar-shaped metal piece integrally connected to the substrate 10. For example, the manufacturing process for each of the welding-fixing portions 13 may be performed as following. Firstly, the substrate 10 is stamped with machine(s) to form the partition holes 141 and a bar-shaped sheets is formed between the partition holes 141. Next, machine(s) is used to stamp or bend the middle portion of the bar-shaped sheet toward the top surface 11 of the substrate 10 so as to form the arch portion 151 of the arch-shaped bridge member 15 protruding from the top surface 11; portions of the bar-shaped sheet which are not stamped or bent form the bridge bases 153 of the arch-shaped bridge member 15 connected to the edge portion of the through hole 14. However, it is understood that, the aforementioned manufacturing method for the welding-fixing portion 13 is provided as an illustrative example, but not limitations of the instant disclosure. The welding-fixing portion 13 may be formed by other processing techniques.

As shown in FIGS. 1 to 3, in this embodiment, the keyboard device 1 may be a computer keyboard and have a plurality of keycaps 20. In this embodiment, three keycaps 20 are illustrated as an example; it is understood that, the keycaps 20 may comprise a plurality of alphabet keys, a plurality of number keys, a space key, an enter key, a caps lock key, etc. A membrane circuit board 40 may be disposed on the top surface 11 of the substrate 10 of the keyboard device 1, and the keycaps 20 are pressibly disposed and arranged on the membrane circuit board 40. For example, a resilient member (not shown) may be between each of the keycaps 20 and the membrane circuit board 40, and the resilient member may be an elastic member or an elastic pin. The frame 30 is disposed on the membrane circuit board 40, so that the membrane circuit board 40 is located between the top surface 11 of the substrate 10 and the frame 30. The frame 30 comprises a plurality of hollow holes 31 respectively corresponding to the keycaps 20. The resilient members are respectively disposed in the hollow holes 31, so that the keycaps 20 can be moved within the hollow holes 31 so as to be pressible. For example, when the keycap 20 is pressed, the keycap 20 is moved toward the membrane circuit board 40 downwardly to trigger a signal and to compress the resilient member to store an elastic force. Conversely, when the keycap 20 is released, the keycap 20 is moved upwardly to the original position of the keycap 20 by the elastic force stored in the resilient member. In other embodiments, the keyboard device 1 may be the key sets of other electronic devices, but embodiments are not limited thereto.

As shown in FIGS. 1 to 4, in this embodiment, the frame 30 is formed by intersecting and connecting a plurality of bars 32 with each other, and the frame 30 comprises welding members 33 for correspondingly welded and fixed with the welding-fixing portions 13 of the substrate 10 (as shown in FIG. 3, each of the bars 32 of the frame 30 comprises the welding member(s) 33). Hence, the frame 30 and the substrate 10 can be assembled and fixed with each other. In this embodiment, the frame 30 may be made of plastic material(s), and the welding members 33 are integrally extending from the bottom portion of the frame 30. In one embodiment, the welding members 33 are disposed at the bottom portion of the frame 30, but embodiments are not limited thereto. It is understood that, the position and the number of the welding members 33 are adjustable according to actual needs. Each of the welding members 33 comprises a plurality of welding posts 334 and a welding-fixing base 332 connected to end portions of the welding posts 334. The welding-fixing base 332 is a base which is formed by a hot-welding treatment and then solidified. The bars 32 of the frame 30 having the welding members 33 are leaned on the arch portions 151, respectively. The welding posts 334 of each of the welding members 33 respectively pass through spaces between the edge portion of the corresponding through hole 14 and the corresponding arch-shaped bridge member 15, and the welding posts 334 of each of the welding members 33 respectively correspond to the partition holes 141 of the corresponding through hole 14. The welding fixing bases 332 are respectively received in the through holes 14 and the recessed portions 152 and do not protrude from the bottom surface 12 of the substrate 10. The manufacturing process for the assembly of the substrate 10 and the frame 30 is described as following.

Figure 5:
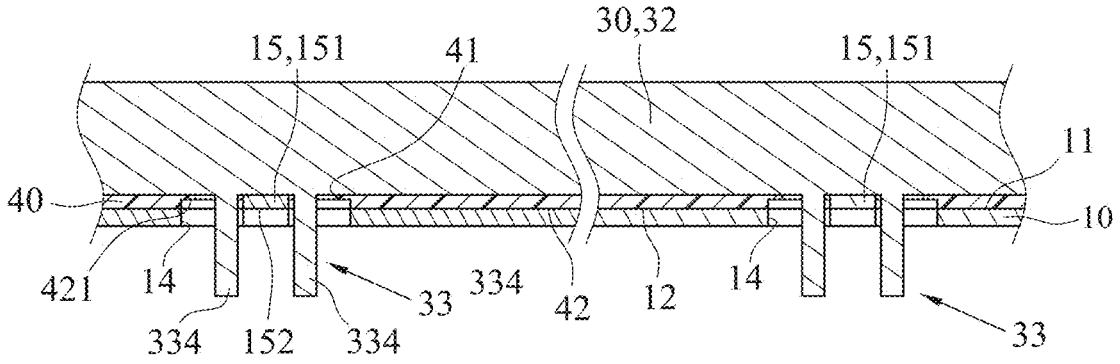
FIG. 5 illustrates a schematic view showing the welding procedure of the keyboard device of the first embodiment.

As shown in FIGS. 3 and 4, in this embodiment, the membrane circuit board 40 comprises a plurality of via holes 41 each corresponding to the through hole 14 of the corresponding welding-fixing portion 13 of the substrate 10. The bottom portion of each of the bars 32 of the frame 30 comprises a plurality of welding members 33. During welding the frame 30 with the substrate 10, the welding posts 334 of each of the welding members 33 of the frame 30 firstly pass through the corresponding via hole 41 of the membrane circuit board 40 and the partition holes 141 of the corresponding through hole 14 of the substrate 10. Please further refer to FIGS. 4 and 5, where FIG. 5 illustrates a schematic view showing the welding procedure of the keyboard device of the first embodiment. In this embodiment, the welding posts 334 of each of the welding members 33 pass through the corresponding via hole 41 and the corresponding partition holes 141 and protrude out of the bottom surface 12 of the substrate 10. In some embodiments, the structure of the welding post 334 may correspond to the shape of the partition hole 141. For example, in the embodiment shown in FIGS. 3 and 4, the partition hole 141 is of a semicircular shape and the welding post 334 is of a semicircular cylinder structure, but embodiments are not limited thereto.

Figure 6:
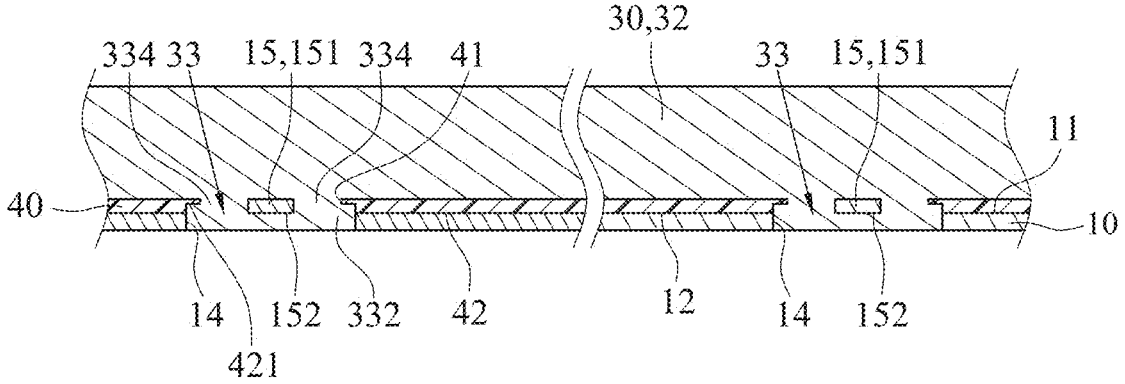
FIG. 6 illustrates a schematic view showing the welding and fixing procedure of the keyboard device of the first embodiment.

Next, as shown in FIG. 6, which illustrates a schematic view showing the welding and fixing procedure of the keyboard device of the first embodiment. After the welding posts 334 of each of the welding members 33 pass through the corresponding via hole 41 and the corresponding partition holes 141 and protrude out of the bottom surface 12 of the substrate 10, the welding posts 334 may be heated by a hot-welding machine, so that the welding posts 334 of each of the welding members 33 become melted fluid which flows into and fills into the corresponding through hole 14, the recessed portion 152 of the corresponding arch-shaped bridge member 15, and the spaces between the edge portion of the corresponding through hole 14 and the corresponding arch-shaped bridge member 15. After the welding posts 334 are cooled and solidified, the welding-fixing base 332 can be formed. Accordingly, the welding member 33 is welded and fixed with the welding-fixing portion 13 of the substrate 10 and encloses the arch-shaped bridge member 15.

Figure 7:
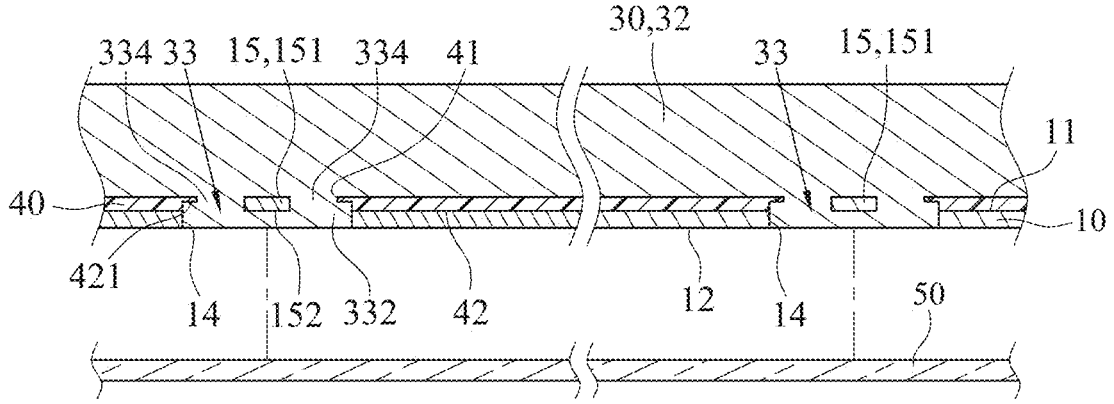
FIG. 7 illustrates a schematic view showing that a backlight module is assembled on the bottom surface of the substrate of the keyboard device of the first embodiment.

Based on the above, in the keyboard device 1 according to one or some embodiments of the instant disclosure, the arch-shaped bridge member 15 is connected in the through hole 14 of the welding-fixing portion 13 of the substrate 10, and the arch-shaped bridge member 15 has the arch portion 151 protruding from the top surface 11 of the substrate 10 and forms the recessed portion 152. Hence, portions of the welding-fixing base 332 of the welding member 33 of the frame 30 can be welded and fixed in the recessed portion 152 and do not protrude out of the bottom surface 12 of the substrate 10. Therefore, the bottom surface 12 of the substrate 10 is even, facilitating the assembly of other components on the bottom surface 12 of the substrate 10. Moreover, the welding member 33 of the frame 30 can enclose the arch-shaped bridge member 15, so that the welding member 30 can have a proper pulling capacity, thereby enhancing the fixation strength of the frame 30 on the substrate 10. Furthermore, the components to be assembled on the bottom surface 12 of the substrate 10 are not necessarily provided with blow holes and still can eschew the welding-fixing base 332. Consequently, the structural strengths of the components to be assembled on the bottom surface 12 of the substrate 10 can be retained, and the performances of the components to be assembled on the bottom surface 12 of the substrate 10 can be properly exploited. As shown in FIGS. 2 and 7, in this embodiment, a backlight module 50 is further assembled on the bottom surface 12 of the substrate 10. Since the welding-fixing base 332 of the welding member 33 of the frame 30 does not protrude out of the bottom surface 12 of the substrate 10, the backlight module 50 does not need to have blow holes for eschewing the welding-fixing base 332. Therefore, the structural strength of the backlight module 50 can be retained, and the backlight module 50 can provide an optimum light emitting performance.

In some embodiments, the size of the arch portion 151 of each of the arch-shaped bridge members 15 of the substrate 10 is greater than a half of the size of the arch-shaped bridge member 15. As shown in FIGS. 2 and 4, in this embodiment, the length of the arch portion 151 of each of the arch-shaped bridge members 15 is greater than a half of the length of the arch-shaped bridge member 15, so that the space within the recessed portion 152 below the arch portion 151 can increase, thereby increasing the size of the portion of the welding-fixing base 332 of the welding member 33 fixed in the recessed portion 152. Hence, the pulling capacity of the frame 30 and the fixation of the frame 30 on the substrate 10 can be enhanced.

Further, as shown in FIG. 2, in some embodiments, the pore diameter of the via hole 41 of the membrane circuit board 40 may be less than the pore diameter of the through hole 14 of the substrate 10, such that the membrane circuit board 40 can cover the edge portions of the through holes 14 of the substrate 10. Accordingly, during welding the frame 30 with the substrate 10 (as shown in FIGS. 5 and 6), the welding posts 334 in the welded state can be blocked by the membrane circuit board 40 and do not overflow upward, and the membrane circuit board 40 is not exposed from portions of the substrate 10 adjacent to the through holes 14. Therefore, the light emitted by the backlight module 50 can be prevented from being reflected by the substrate 10 and leaking from the through holes 14, which would adversely affect the light emitting performance of the keyboard device 1. Alternatively, as shown in FIG. 2, in some embodiments, the bar 32 of the frame 30 may cover the via hole 41 of the membrane circuit board 40 and the through hole 14 of the substrate 10 to prevent the light emitting performance of the keyboard device 1 from being adversely affected.

As shown in FIGS. 2, 5, and 6, in some embodiments, the membrane circuit board 40 has a lower surface 42 facing the top surface 11 of the substrate 10, and a portion of the lower surface 42 adjacent to an edge portion of the via hole 41 further comprises a groove 421. Accordingly, during welding the frame 30 with the substrate 10, the welding posts 334 in the welded state can further flow into the groove 421 at the lower surface 42 of the membrane circuit board 40. Therefore, the welding posts 334 in the welded state would overflow out of the through hole 14 more difficultly. Moreover, when the welding post 334 is solidified, the welding-fixing base 332 of each of the welding members 33 is further received and fixed in the groove 421, so that the membrane circuit board 40 and the substrate 10 can be fixedly assembled with each other.

Figure 8:
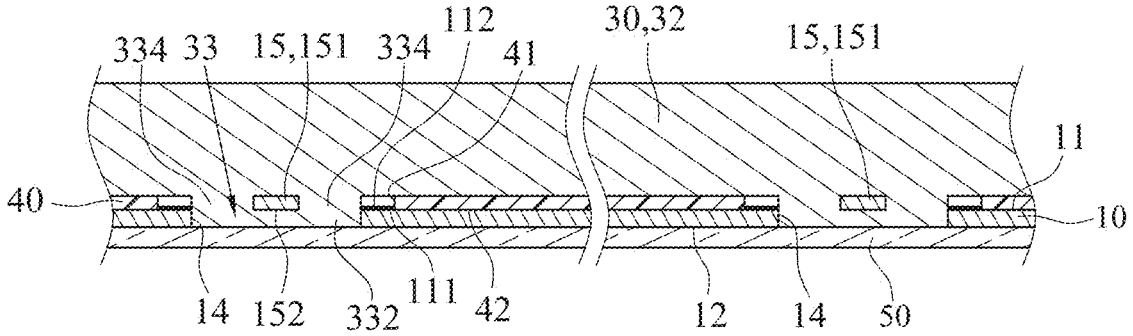
FIG. 8 illustrates a cross-sectional view of a keyboard device according to a second embodiment of the instant disclosure.

Please refer to FIG. 8. FIG. 8 illustrates a cross-sectional view of a keyboard device according to a second embodiment of the instant disclosure. The difference between the embodiment shown in FIG. 2 and this embodiment is at least that, in this embodiment, the pore diameter of the via hole 41 of the membrane circuit board 40 is greater than the pore diameter of the through hole 14 of the substrate 10. Therefore, the top surface 11 of the substrate 10 has an exposed region 111, and the exposed region 111 is located between the edge portion of the via hole 41 and the edge portion of the through hole 14. In this embodiment, the exposed portion 111 of the substrate 10 may comprise a shielding layer 112. The shielding layer 112, for example, may be a dark colored ink layer or a dark colored glue layer, and the shielding layer 112 is adapted to prevent the light emitted by the backlight module 50 from leaking from the through holes 14, which would adversely affect the light emitting performance of the keyboard device 10. Alternatively, in some embodiments, the bar 32 of the frame 30 may cover the exposed region 111 of the substrate 10 to prevent the light emitting performance of the keyboard device 1 from being adversely affected.

Figure 9:
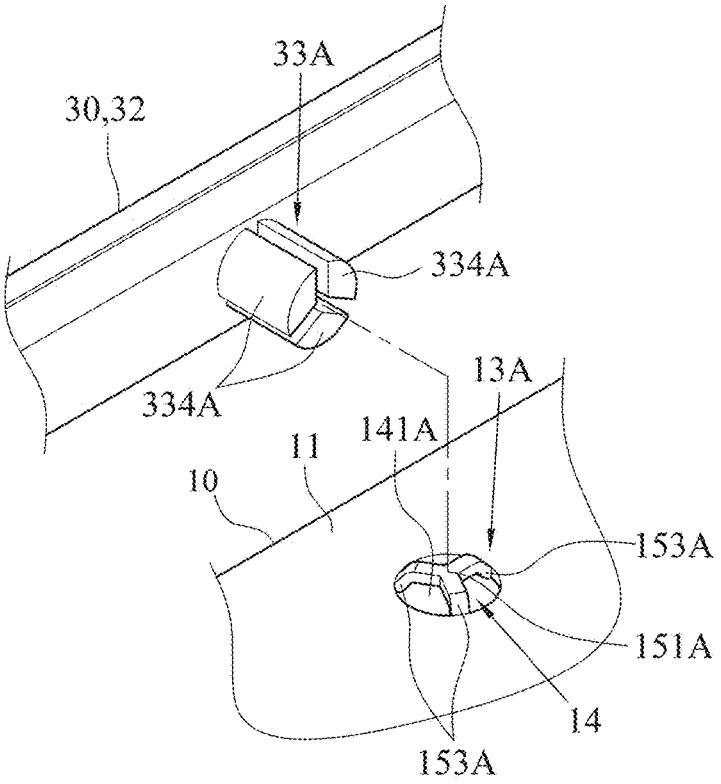
FIG. 9 illustrates a partial exploded view of a keyboard device according to a third embodiment of the instant disclosure.

In some embodiments, the number of the bridge bases 153 of each of the welding-fixing portions 13 may be three or more, and the bridge bases 153 are equiangularly disposed with respect to a center portion of the arch portion 151. Please refer to FIG. 9. FIG. 9 illustrates a partial exploded view of a keyboard device according to a third embodiment of the instant disclosure. The difference between the embodiment(s) shown in FIGS. 3 and 4 and this embodiment is at least that, in this embodiment, the arch portion 151A of the welding-fixing portion 13A is of a Y shape, and the welding-fixing portion 13A has three bridge bases 153A respectively connected between three end portions of the arch portion 151A and the edge portion of the through hole 14. Therefore, the three bridge bases 153A are equiangularly disposed (in this embodiment, 120 degrees) by taking the arch portion 151A as the center, and the three bridge bases 153A divide the through hole 14 into three partition holes 141A. During welding the frame 30 with the substrate 10, the welding member 33A of the frame 30 has three welding posts 334A for correspondingly passing through the three partition holes 141A for welding. Accordingly, as compared with the linear arch portion 151 of the embodiment shown in FIG. 3, the Y-shaped arch portion 151A in this embodiment further increases the size of the portion of the welding member 33A fixed within the space below the arch portion 151A. Hence, the pulling capacity of the frame 30 and the fixation of the frame 30 on the substrate 10 can be further enhanced.

Figure 10:
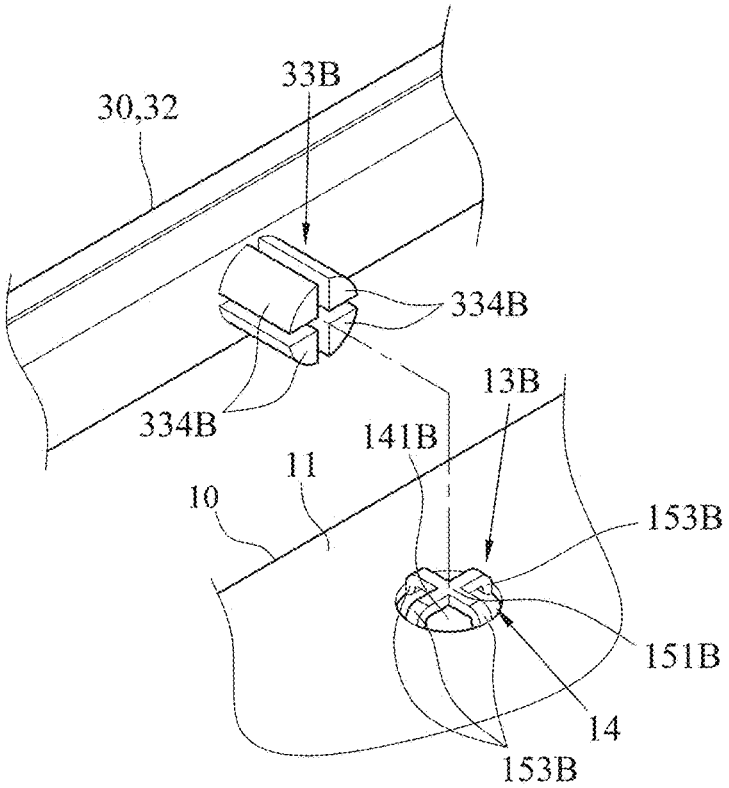
FIG. 10 illustrates a partial exploded view of a keyboard device according to a fourth embodiment of the instant disclosure.

Alternatively, as shown in FIG. 10, a partial exploded view of a keyboard device according to a fourth embodiment of the instant disclosure is illustrated. The difference between the embodiment(s) shown in FIGS. 3 and 4 and this embodiment is at least that, in this embodiment, the arch portion 151B of the welding-fixing portion 13B is of a cross shape, and the welding-fixing portion 13B has four bridge bases 153B respectively connected between four end portions of the arch portion 151B and the edge portion of the through hole 14. Therefore, the four bridge bases 153B are equiangularly disposed (in this embodiment, 90 degrees) by taking the arch portion 151B as the center, and the four bridge bases 153B divide the through hole 14 into four partition holes 141B. During welding the frame 30 with the substrate 10, the welding member 33B of the frame 30 has four welding posts 334B for correspondingly passing through the four partition holes 141B for welding. Accordingly, as compared with the linear arch portion 151 of the embodiment shown in FIG. 3, the Y-shaped arch portion 151B in this embodiment further increases the size of the portion of the welding member 33B fixed within the space below the arch portion 151B. Hence, the pulling capacity of the frame 30 and the fixation of the frame 30 on the substrate 10 can be further enhanced.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A keyboard device comprising:

a substrate having a top surface and a bottom surface opposite to the top surface, wherein the substrate comprises a welding-fixing portion, the welding-fixing portion comprises a through hole and an arch-shaped bridge member, the through hole is defined through the top surface and the bottom surface, the arch-shaped bridge member is connected in the through hole, the arch-shaped bridge member divides the through hole into a plurality of partition holes, the arch-shaped bridge member has an arch portion and a plurality of bridge bases extending from the arch portion, the bridge bases are connected to an edge portion of the through hole, and the arch portion protrudes from the top surface to form a recessed portion;

a plurality of keycaps disposed on the top surface of the substrate; and a frame disposed on the top surface of the substrate, wherein the frame comprises a plurality of hollow holes respectively corresponding to the keycaps, the frame comprises a welding member, the welding member comprises a plurality of welding posts and a welding-fixing base connected to end portions of the welding posts, the frame is leaned on the arch portion, the welding posts respectively pass through spaces between the edge portion of the through hole and the arch-shaped bridge member, the welding posts respectively correspond to the partition holes, the end portions of the welding posts are hot-welded and solidified to form the welding-fixing base, and the welding-fixing base is received and fixed in the through hole and the recessed portion.

2. The keyboard device according to claim 1, wherein the frame comprises a bar, and the welding member is disposed on the bar.

3. The keyboard device according to claim 1, wherein a number of the bridge bases is two, and the two bridge bases are extending from two opposite ends of the arch portion.

4. The keyboard device according to claim 1, wherein a number of the bridge bases is three or more, and the bridge bases are equiangularly disposed with respect to a center portion of the arch portion.

5. The keyboard device according to claim 1, wherein a membrane circuit board is further disposed between the top surface of the substrate and the frame, the membrane circuit board comprises a via hole corresponding to the through hole, and the welding posts of the welding member further pass through the via hole.

6. The keyboard device according to claim 5, wherein the membrane circuit board has a lower surface, a portion of the lower surface adjacent to an edge portion of the via hole further comprises a groove, and the welding-fixing base is further received and fixed in the groove.

7. The keyboard device according to claim 5, wherein a pore diameter of the via hole is less than a pore diameter of the through hole.

8. The keyboard device according to claim 5, wherein the frame further covers the via hole and the through hole.

9. The keyboard device according to claim 5, wherein a pore diameter of the via hole is greater than a pore diameter of the through hole, the top surface of the substrate has an exposed region, and the exposed region is located between the edge portion of the via hole and the edge portion of the through hole.

10. The keyboard device according to claim 9, wherein the exposed region further comprises a shielding layer.

11. The keyboard device according to claim 1, wherein a backlight module is further assembled on the bottom surface of the substrate, and a portion of the backlight module corresponding to the welding-fixing base is devoid of blow holes.

12. The keyboard device according to claim 1, wherein a size of the arch portion is greater than a half of a size of the arch-shaped bridge member.

* * * * *